United States Patent [19]

Delassus

[11] 4,294,304

[45] Oct. 13, 1981

[54] ELECTROMAGNETIC CENTRIFUGING INDUCTOR FOR ROTATING A MOLTEN METAL ABOUT ITS CASTING AXIS

[75] Inventor: Jean Delassus, Montmorency, France

[73] Assignee: CEM - Compagnie Electro-Mecanique, Paris, France

[21] Appl. No.: 802,128

[22] Filed: May 31, 1977

[30] Foreign Application Priority Data

Jun. 14, 1976 [FR] France ..... 76 17919

[51] Int. Cl.[3] ..... B22D 27/02

[52] U.S. Cl. ..... 164/504; 164/468

[58] Field of Search ..... 164/48, 49, 84, 146, 164/147; 310/184, 185, 186, 187, 198, 256

[56] References Cited

U.S. PATENT DOCUMENTS

| | | | |
|---|---|---|---|
| 2,310,501 | 2/1943 | Waldvogel | 310/156 |
| 2,761,082 | 8/1956 | Chang | 310/166 |
| 2,802,123 | 8/1957 | Tweedy et al. | 310/187 |
| 2,944,309 | 7/1960 | Schaaber | 164/147 |
| 2,963,758 | 12/1960 | Pestel et al. | 164/29 |
| 3,241,304 | 3/1966 | Mattingly et al. | 310/157 |
| 3,886,387 | 5/1975 | Graham et al. | 310/256 |
| 3,905,417 | 9/1975 | Delassus | 164/147 |
| 3,986,062 | 10/1976 | Morrill | 310/184 |

*Primary Examiner*—Robert D. Baldwin
*Assistant Examiner*—K. Y. Lin
*Attorney, Agent, or Firm*—Burns, Doane, Swecker & Mathis

[57] ABSTRACT

An electromagnetic centrifuging inductor structure for creating a rotating magnetic field for rotating molten metal about its casting axis while passing through the casting conduit of a continuous casting type ingot mold includes an annular core body of magnetic material surrounding the casting conduit and which is provided with six poles or teeth on which are respectively mounted six different arcuate coils for energization by a three-phase a.c. source. Two coils are provided for each phase and these are so distributed that two coils of the same phase have different radii, are mounted on two diametrically opposite teeth and are coupled in such manner that their generated magnetic fluxes are additive. The coils are mounted in recesses formed between adjacent teeth and the coils of different phases partially overlap within the same recess.

2 Claims, 3 Drawing Figures

ELECTROMAGNETIC CENTRIFUGING INDUCTOR FOR ROTATING A MOLTEN METAL ABOUT ITS CASTING AXIS

FIELD OF THE INVENTION

The present invention relates to an electromagnetic centrifuging inductor for the purpose of rotating a molten metal about its casting axis and comprises a wound magnetic core located in an annular tank in which there is substantial water circulation, the coils being fed by low voltage and low-frequency three-phase AC.

The invention more particularly applies to an ingot mold with a vertical axis, or an axis slightly inclined to the vertical, where this mold is of the generally conventional basic type used to generate continuous casting of a metal ingot of a high melting point, such as steel or ferrous alloys.

BACKGROUND OF THE INVENTION

It is known that rotating a molten metal or alloy at a given speed allows separation by centrifugal force of the impurities or inclusions from the slag contained in a molten metal bath, the lighter particles being returned to the center and rising to the bath surface, where they may be collected by known means.

In other cases, the centrifuging process allows elimination of certain specific alloy constituents from the peripheral region of the ingot for the purpose of reducing the surface hardness of products meant for lamination.

To date, rotation has been mainly achieved by mechanical means in that the ingot mold has been made to rotate as well as the sum of the casting supports about the casting axis; this implies heavy and costly equipment.

Again it has been proposed to achieve a local rotation of the molten metal by means of a rotating magnetic field by placing an electromagnetic rabbling system such as described in French Pat. No. 2 211 305 in the path of the continuous casting and some distance below the ingot mold.

This system allows rotation of the liquid contained inside the ingot when the latter is solidifying and also allows an improvement in homogeneity and crystalline structure of the ingot core.

Such equipment is already found in many continuous steel casting systems, and its range of activity is about 3 meters vertically below the ingot-mold level, in a zone generally termed "secondary cooling zone". At the level of this secondary cooling and on account of ample sprinkling of the ingot from sprinkler banks, the thickness of the solidified wall may reach several centimeters. Therefore the electromagnetic rabbling effect (centrifuging) comes too late to be useful at the ingot periphery.

Now certain steel-and-iron metallurgical applications such as for instance the fabrication of weldless tubing from solid ingots make it desirable to achieve ingots with very high surface quality so as to avoid tube cracking during lamination.

In fact, cracking is initiated because of the slag inclusions retained in the ingot wall at the onset of solidification, i.e., when the metal is in the ingot mold, which represents the primary cooling zone upon leaving which the required solidified wall thickness for ingot strength varies from several millimeters to one centimeter depending on ingot size.

If the product leaving the inductor described in the above cited French patent is to be laminated, the outer ingot crust must be rid, by grinding, of the visible impurities; this is a long and costly labor.

On the other hand, if the molten metal is to be rotated magnetically at the level of the ingot-mold, of which the casting conduit generally is made of copper, or of a copper alloy, and which is quite thick, then this casting conduit opposes the penetration of the magnetic field into the molten metal. The inductor described in the above cited French patent does not allow generating a rotating field with properties sufficient to achieve such rotation, because the insulated water-resistant wires located in the recesses do not allow achieving the proper magnetic field intensity on account of the excessive large volume required by the insulation.

Lastly, when a coil of the type described in the above-cited French patent is used, and there is an accident to the ingot-mold, a long time is required to put the inductor coils back in operation.

SUMMARY OF THE INVENTION

The principal purpose of the present invention is to create a low-frequency magnetic field at the level of the ingot mold with an intensity sufficient to pass through the casting conduit of the ingot mold and the molten metal, and to achieve this in embodiments of easy operation.

To that end the improved inductor structure for creating a rotating magnetic field includes an annular body of magnetic material surrounding the casting conduit of the ingot and which is provided with six poles or teeth distributed uniformly about its inner surface and which extend radially inward. A prefabricated arcuate pole coil is mounted on each tooth, there being two coils for each of the three phases, and the coils are so distributed that two coils of the same phase have different radii and are mounted on two opposite teeth and so coupled that their generated magnetic fluxes are additive. One of the two coils of the same phase is located at the bottom of two recesses adjacent to the corresponding tooth and the other coil belonging to that same phase is located at the rim of the two recesses adjacent to the opposite tooth, and the coils of two different phases partially overlap within the same recess.

It is already known how to place a rabbling inductor around a casting conduit in the water chamber of an ingot mold (German application, Offenlegungsschrift No. 1 783 060), but rabbling achieved in conformity with this German patent application follows along the generatrices of a torus and it is meant to homogenize the ingot mass. As regards the arrangement of the present invention, on the other hand, there is no ingot homogenization, rather there is centrifuging by rotating the molten metal about the casting axis, so that the surface quality of the continuous-casting ingots is improved by applying centrifugal separation of the inclusions.

Furthermore, thanks to the intense magnetic field generated by the inductor of the present invention, a multi-purpose inductor may be achieved which allows centrifuging the metal contained in ingot-mold tubing of different sizes so that a multi-caliber ingot-mold might be achieved which is equipped with a single inductor.

BRIEF DESCRIPTION OF THE DRAWINGS

A preferred embodiment of the present invention will now be described below in reference to the attached drawings, wherein.

DETAILED DESCRIPTION OF PREFERRED EMBODIMENT

Figure 1:
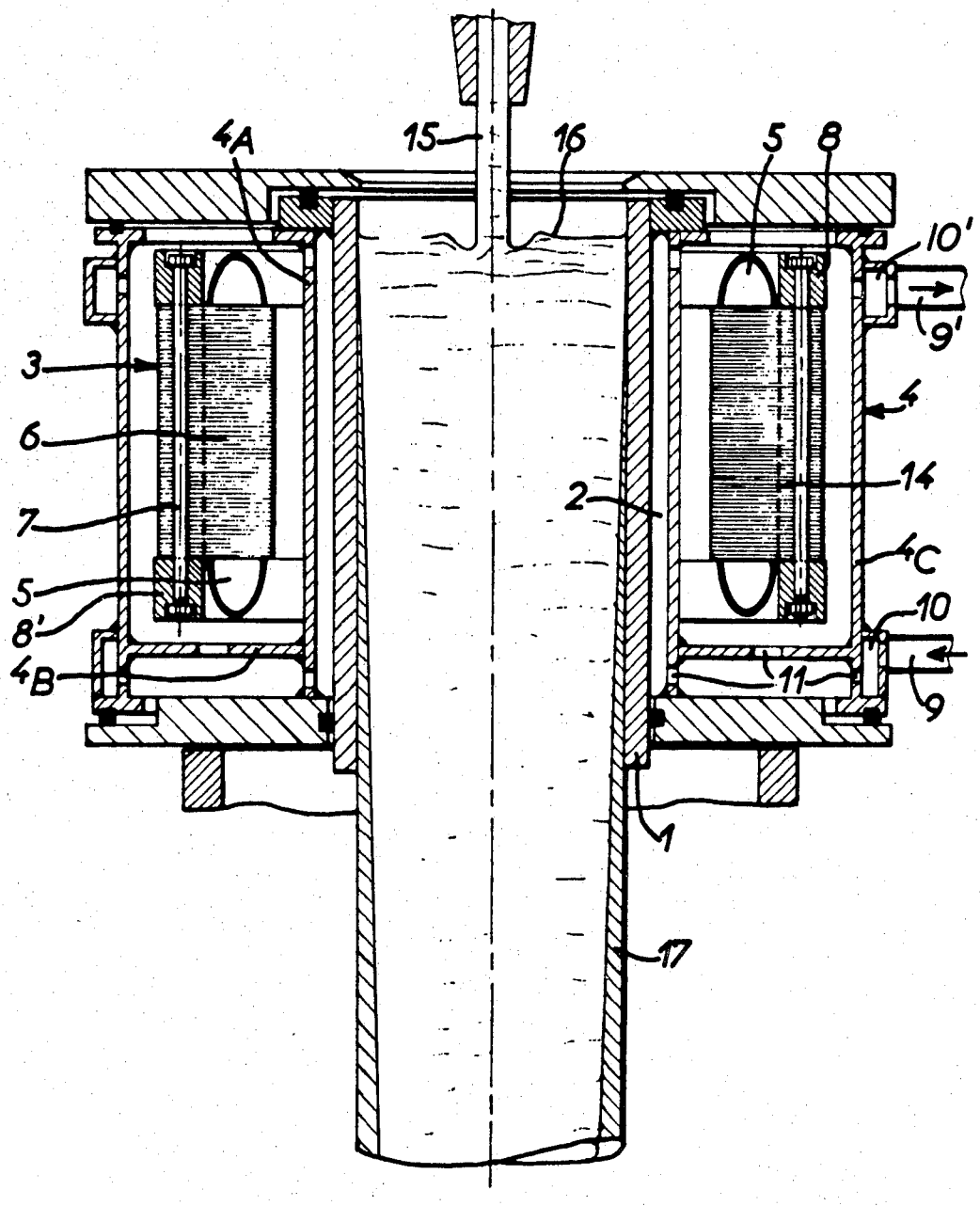
FIG. 1 shows an ingot-mold equipped with an inductor of the invention in vertical section.

FIG. 1 shows the casting conduit 1, which is made of copper, of the ingot mold, surrounded by a water-cooling jacket 2. For the sake of illustration, the following are also shown: the continuous liquid metal jet 15 feeding the ingot-mold, metal level 16 and progressively forming solid wall 17.

Inductor 3 is placed into an annular tank 4 through which passes a strong current of water. Next to conduit 1 of the ingot mold, tank 4 consists of a high electrical-resistance non-magnetic pipe $4_A$, preferably of stainless steel. The coil ends 5 of inductor 3 are located below and above teeth 6 of the inductor's magnetic circuit, said inductor consisting in a manner known per se of a stack of annular plane magnetic laminations which are tightened by tie rods 7 and end rings 8 and 8' and made of highly conducting metal as high as coil ends 5 and meant to reflect the magnetic field towards the center of the ingot mold.

The annular inductor structure 3 with its six coils to be described below in further detail is supported within an annular tank 4 which surrounds the casting conduit 1 in radially spaced relation to establish the water jacket 2. Water for cooling, enters the tank 4 through a pipe 9 connected to a bustle pipe 10 located at the bottom of the tank and the water after circulating through the tank from the bottom to the top leaves the tank through a bustle pipe 10' and pipe 9'. Peripherally distributed orifices 11 in the inner and outer walls 4A, 4C and in the bottom wall 4B deliver water to the water jacket 2 for cooling the casting conduit 1 and to the interior of the tank 4 for cooling the inductor structure 3.

Figure 2:
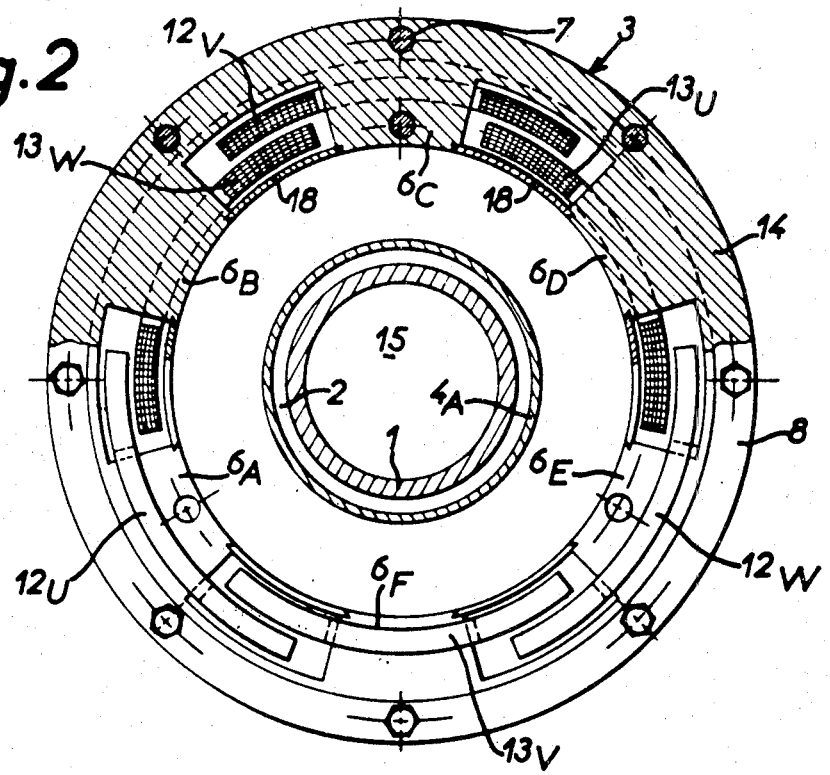
FIG. 2 shows the inductor partly in cross-section and partly in top view.

As shown by FIG. 2, one set of three prefabricated and pre-impregnated arcuate coils $12_U$, $12_V$, and $12_W$, respectively fed by phases U, V, W of a three-phase power source are located respectively around teeth $6_A$, $6_C$, and $6_E$ of the magnetic circuit. Each of the three coils $12_U$, $12_V$, and $12_W$ is located at the bottom of two recesses adjacent to the corresponding tooth $6_A$, $6_C$, and $6_E$, and they are so designed that they can be placed around said corresponding teeth without being subjected to deformation. Their dimensions in the sense of the periphery of the magnetic circuit therefore must take into account being placed into position without touching the neighboring teeth. Stated more precisely, the width of each coil is less than the total width of one tooth plus the two recesses adjacent to this tooth. Furthermore, the curvature of the coils is such as to achieve optimum emplacement in the recesses.

Similarly, the other set of three prefabricated and preimpregnated coils $13_U$, $13_V$, and $13_W$ fed by phases of U, V, and W of the three-phase power source are respectively placed around teeth $6_D$, $6_F$, and $6_B$. Each of the three coils $13_U$, $13_V$, and $13_W$ is located at the rim of the two recesses adjacent to the corresponding tooth $6_D$, $6_F$, or $6_B$. Coils $12_U$ and $13_U$, which are respectively arranged around two diametrically opposite teeth $6_A$ and $6_D$ and which are fed from the same phase U, are so coupled that the flux they generate is additive. The same applies to coils $12_V$ and $13_V$ and to coils $12_W$ and $13_W$. Coils $13_U$, $13_V$, and $13_W$ are therefore of lesser radii of curvature than those of coils $12_U$, $12_V$, and $12_W$ since the former lie at the rim of the recesses established between adjacent teeth. It will be noted furthermore that the coils with different phases are consecutively arrayed on teeth $6_A$ through $6_F$ and partly overlap in pairs.

The ends of the six teeth $6_A$ through $6_F$ are dovetailed so as to allow insertion of an insulating key 18 to seal the recess and keep the coils in position. The six teeth are also seen to have a uniform circumferential spacing about the inner periphery of the annular core and they all project radially inward towards a center of the inductor coincident with the casting axis shown by the broken line in FIG. 1.

The coils are made on a winding form using a flat copper conductor covered with a water-impermeable, relatively thin insulating layer such as a "Kapton" film. Thereupon the coils are sheathed in fiberglass and thoroughly impregnated with a thermosetting resin which imparts to them very high mechanical strength, satisfactory protection regarding water immersion, and also good insulation between turns and with respect to ground. Each coil so made is a compact block with a high cross-section of copper with regard to the total coil cross-action, thus allowing the generation of an intense magnetic field.

The superposition and overlap of coils with two consecutive phases in the same recess provide good progressiveness in rotation of the magnetic field, whereby the amplitude of the spatial harmonics is reduced. This is because the even harmonics cannot exist in the described coil with double layers per recess and because the third order harmonic and its multiples cannot exist in a three-phase assembly, so that only the $(6K\pm1)$ harmonics may remain, of which the most bothersome are the 5th and 7th orders. But even these latter are strongly decreased by the overlap of the phases within each recess. Therefore an excellent waveshape is obtained, with resulting minimum power consumption for a given inductor emf. This consumption is still further reduced if each lamination of the magnetic circuit of inductor 3 is fabricated in a manner known per se from a single stamped sheet so as to obtain an outer crown 14 and six inner teeth $6_A$ through $6_F$ of one piece with crown 14, provided the field reflecting rings 8 and 8' are properly sized.

Thanks to the whole of these provisions, an inductor in conformity with the invention can generate an intense magnetic field of the order of 1000 A/cm with a minimum of voltage, so that the insulation volume may be made a minimum with respect to the dielectric stresses and water immersion.

Figure 3:
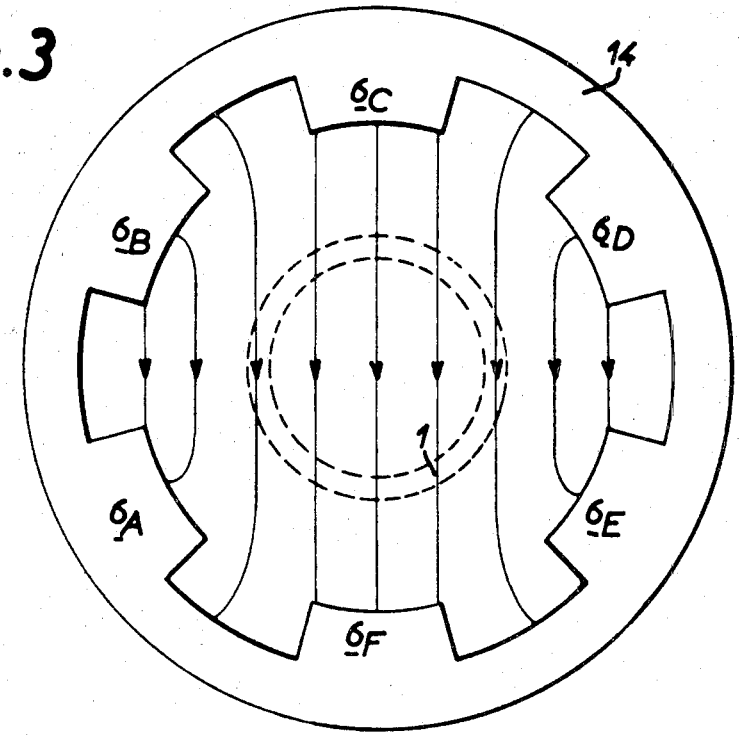
FIG. 3 shows the magnetic field generated by the inductor.

FIG. 3 shows the flux generated by the three-phase inductor at the time when the current is maximum in coils 12 and 13 of phase V and is equal to $(-\frac{1}{2})$ times this maximum in coils 12 and 13 of phases U and W.

It may be noted that this magnetic field is practically uniform inside the air-gap of inductor 3, so that all the ingots of various sizes capable of being molded within the volume of inductor 3 will be rabbled with the same effectiveness.

Inductor 3 therefore is multi-purpose and particularly well suited for a multi-caliber ingot mold.

Even though the invention applies more particularly to a continuous-casting ingot-mold as described above, it also applies to ingot-molds provided with a bottom for casting finite lengths ingots.

It is further understood that the above described embodiment is offered purely for illustrative purposes and by no means implies restriction, and that various modifications may be introduced without thereby departing from the scope of the invention.

I claim:

1. Apparatus for producing rotation of a molten metal body about its axis while it is being cast to create a centrifuging effect comprising a casting conduit, an annular tank filled with a fluid coolant surrounding said casting conduit, an annular electromagnetic centrifuging inductor structure mounted within said tank, said inductor structure comprising an annular core body of a magnetic material provided with six uniformly circumferentially spaced teeth projecting in a radially inward direction towards a center coincident with the casting axis, arcuate coils mounted respectively on each of said teeth for energization from a three-phase a.c. source, there being two coils provided for each phase which are mounted on two diametrically opposite teeth and are electrically connected such that their generated magnetic fluxes are additive and bi-polar.

2. Apparatus as defined in claim 1 for producing rotation of a molten metal body about its axis while being cast in order to create a centrifuging effect and wherein end rings made from a highly conductive material are applied to the end faces of the annular core body component of said inductor structure outside of the ends of said coils for reflecting the magnetic field radially inward toward the center of said casting conduit.

* * * * *